US007464773B2

(12) United States Patent
Rives

(10) Patent No.: US 7,464,773 B2
(45) Date of Patent: Dec. 16, 2008

(54) ENHANCED DRILL BIT LUBRICATION APPARATUS AND METHOD

(76) Inventor: Allen Kent Rives, 11831 Pebbleton, Houston, TX (US) 77007

( * ) Notice: Subject to any disclaimer, the term of this patent is extended or adjusted under 35 U.S.C. 154(b) by 129 days.

(21) Appl. No.: 11/465,727

(22) Filed: Aug. 18, 2006

(65) Prior Publication Data

US 2008/0041627 A1 Feb. 21, 2008

(51) Int. Cl.
*E21B 10/08* (2006.01)
*E21B 10/24* (2006.01)

(52) U.S. Cl. ..... 175/57; 175/227; 175/343; 175/353; 175/372

(58) Field of Classification Search ..... 175/337, 175/343, 371, 372, 227, 228, 350, 353, 57
See application file for complete search history.

(56) References Cited

U.S. PATENT DOCUMENTS 4,096,917 A * 6/1978 Harris ..... 175/228
4,254,838 A * 3/1981 Barnetche ..... 175/228
4,359,111 A * 11/1982 Gonzalez ..... 175/227
6,892,828 B2 * 5/2005 Rives ..... 175/19

* cited by examiner

*Primary Examiner*—David J Bagnell
*Assistant Examiner*—Robert E Fuller
(74) *Attorney, Agent, or Firm*—The Dickinson Law Offices; David B. Dickinson

(57) ABSTRACT

A lubricating nutating single cone drill bit 10 includes bit shank 12 with an axially skewed journal 18 rotatably retaining cutter body 22. Bearings (26, 28, 30, 32) enable rotation of the cutter body 22. Lubrication flows to a gap between the axially skewed journal 18 and cutter body 22 from lubricant chamber 76 having plunger 80 acted on by an annulus fluid, the gap bounded by first 66 and second 68 radial dynamic seals. A fluid passage 90 extending through the bit 10 communicates with fluid inlet port 88 on the proximal end 16 of the bit shank 12. Fluid passage 90 also communicates with a first fluid outlet port 98 on the distal end 36 of the axially skewed journal 18 and with a second fluid outlet port 94 formed on a lateral portion of bit shank 12.

8 Claims, 2 Drawing Sheets

ENHANCED DRILL BIT LUBRICATION APPARATUS AND METHOD

BACKGROUND

The present invention generally relates to drill bits for boring subterranean and sub sea formations. More particularly, the present invention relates to a lubricating nutating single cone drill bit having an axis of rotation skewed relative to the central axis of the bit body in the borehole providing low torque and allowing high compressive loading on the bit assembly.

A number of single cone drill bits have been proposed through the years to drill bore holes for mining, oil and gas exploration, and utility construction. It has been previously recognized that a single cone bit would offer superior design characteristics, such as bearing size permitting greater longitudinal compressive loading on the drill bit. A nutating single cone drill bit, for example the ones disclosed in U.S. Pat. No. 6,892,828 and PCT Pat. App. No. US2006/013540 entitled Drill Bit Lubrication Apparatus and Method, each incorporated by reference herein, can offer the advantage of long wearing cutter or crusher elements. Typically, traditional tricone bits must be repeatedly tripped out of the borehole due to excessively worn cutter elements.

A nutating single cone drill bit allows a longer service life, however these extended periods of downhole use can be limited by the amount of lubrication available to maintain the bearings of the nutating single cone drill bit. Without sufficient lubrication, the bearings can fail prior to the cutter, or crusher, elements of the bit requiring replacement, limiting the usefulness of the nutating single cone drill bit.

SUMMARY OF THE INVENTION

The present invention is directed to a nutating drill bit, more specifically, a lubricating nutating single cone drill bit. A lubricant chamber in the bit shank can dispense a lubricant into the rotationally contacting bearing surfaces, for example, a thrust, radial, or ball bearing. A plurality of radial dynamic seals restricts contaminants from contacting the bearing surfaces and preferably extends the life of any bearings to at least the useful life of the cutter or crushing elements on the drill bit body. Added lubrication can mitigate the need to trip the drill bit into and out of the well bore to replace or repack lubrication in a bit whose cutter or crushing elements are not worn sufficiently to be removed from service.

A lubricating nutating single cone drill bit can include a bit shank having a drill string connection on a proximal end and an axially skewed journal on a distal end, at least one bearing rotatably retaining a cutter body on the axially skewed journal, a plurality of cutter elements affixed to a distal end of the cutter body so that a tip of each cutter element is forward an intersection of a central axis of the bit shank and an axis of rotation of the cutter body and a first radial distance to the tip of each cutter element from the axis of rotation of the cutter body is longer than a second radial distance to said tip of each cutter element from the central axis of the bit shank when in engagement with a well bore floor, and a lubricant chamber in the bit shank in communication with a fluid inlet port on an exterior of the bit shank. The lubricant chamber can contain a plunger to restrict the ingress of an annulus or other fluid to the lubricant chamber. The lubricant chamber can include a snap ring retained in a groove thereof to restrict the passage of the plunger.

The bit can include a fluid outlet port on a distal end of the journal extending through an opening in the cutter body and in communication with a fluid passage in the bit shank, the fluid passage in communication with a second fluid inlet port in the proximal end of the bit shank and/or a second fluid outlet port on the exterior of the bit shank in communication with the fluid passage.

The at least one bearing can include at least one ball bearing disposed between a first channel formed in the axially skewed journal and a second channel formed in an interior of the cutter body. The axially skewed journal can include a narrow portion at a distal end and a thrust shoulder adjacent the narrow portion. The at least one bearing can include a thrust bearing disposed between the thrust shoulder of the axially skewed journal and a thrust shoulder in the interior of the cutter body. The at least one bearing can include at least one radial bearing between the axially skewed journal and the cutter body. A first radial dynamic seal can be disposed between a proximal end of the cutter body and the axially skewed journal and/or a second radial dynamic seal can be disposed between the distal end of the cutter body and the axially skewed journal.

The bit can include a ball bearing passage connecting an aperture in the first channel and an aperture in the lubricant chamber to allow the insertion of the at least one ball bearing therethrough. The bit can include a ball bearing retention sleeve disposed in the lubricant chamber adjacent the aperture of the ball bearing passage to retain the at least one ball bearing between the first and the second channel. At least one of the fluid outlet ports can include a jetting nozzle or a low pressure orifice.

In another embodiment, a method to drill a formation can include attaching a lubricating nutating single cone drill bit having a drill string connection on a proximal end and an axially skewed journal on a distal end, at least one bearing rotatably retaining a cutter body on the axially skewed journal, a plurality of cutter elements affixed to a distal end of the cutter body so that a tip of each cutter element is forward an intersection of a central axis of the bit shank and an axis of rotation of the cutter body and a first radial distance to the tip of each cutter element from the axis of rotation of the cutter body is longer than a second radial distance to said tip of each cutter element from the central axis of the bit shank when in engagement with a well bore floor, and a lubricant chamber in the bit shank in communication with a fluid inlet port on an exterior of the bit shank to a drill string to collectively form an assembly, engaging the assembly into the formation, rotating the drill string to drill the formation with the lubricating nutating single cone drill bit to produce a well bore, and pumping the drilling fluid through the drill string into the second fluid inlet port and out of the first and the second fluid outlet ports, the lubricant chamber dispensing a lubricant to the at least one bearing. The method can include removing the lubricating nutating single cone drill bit from the well bore and/or replenishing the lubricant in the lubricant chamber.

A method of assembling a lubricating nutating single cone drill bit can include providing a bit shank having a drill string connection on a proximal end and an axially skewed journal on a distal end, providing a lubricant chamber in the bit shank in communication with a fluid inlet port on an exterior of the bit shank, a plunger disposed in the lubricant chamber, rotatably retaining a cutter body on the axially skewed journal with at least one bearing, the cutter body having a plurality of cutter elements affixed to a distal end of the cutter body so that a tip of each cutter element is forward an intersection of a central axis of the bit shank and an axis of rotation of the cutter body and a first radial distance to the tip of each cutter element from the axis of rotation of the cutter body is longer than a second radial distance to said tip of each cutter element from the central axis of the bit shank, and disposing a lubricant into the lubricant chamber, the lubricant chamber in communication with the at least one bearing. The step of disposing the lubricant into the lubricant chamber can include retaining the plunger adjacent the fluid inlet port, disposing the lubricant through a longitudinal bore in the plunger, and sealing the longitudinal bore in the plunger with a plug. The step of rotatably retaining a cutter body on the axially skewed journal with at least one bearing further can include disposing at least one ball bearing through a ball bearing passage into a race formed between the axially skewed journal and the cutter body, the ball bearing passage extending from the lubricant chamber into the race, and inserting a ball bearing retention sleeve into the lubricant chamber adjacent the ball bearing passage, the sleeve preventing the egress of the at least one ball bearing from the race.

DETAILED DESCRIPTION

Figure 1:
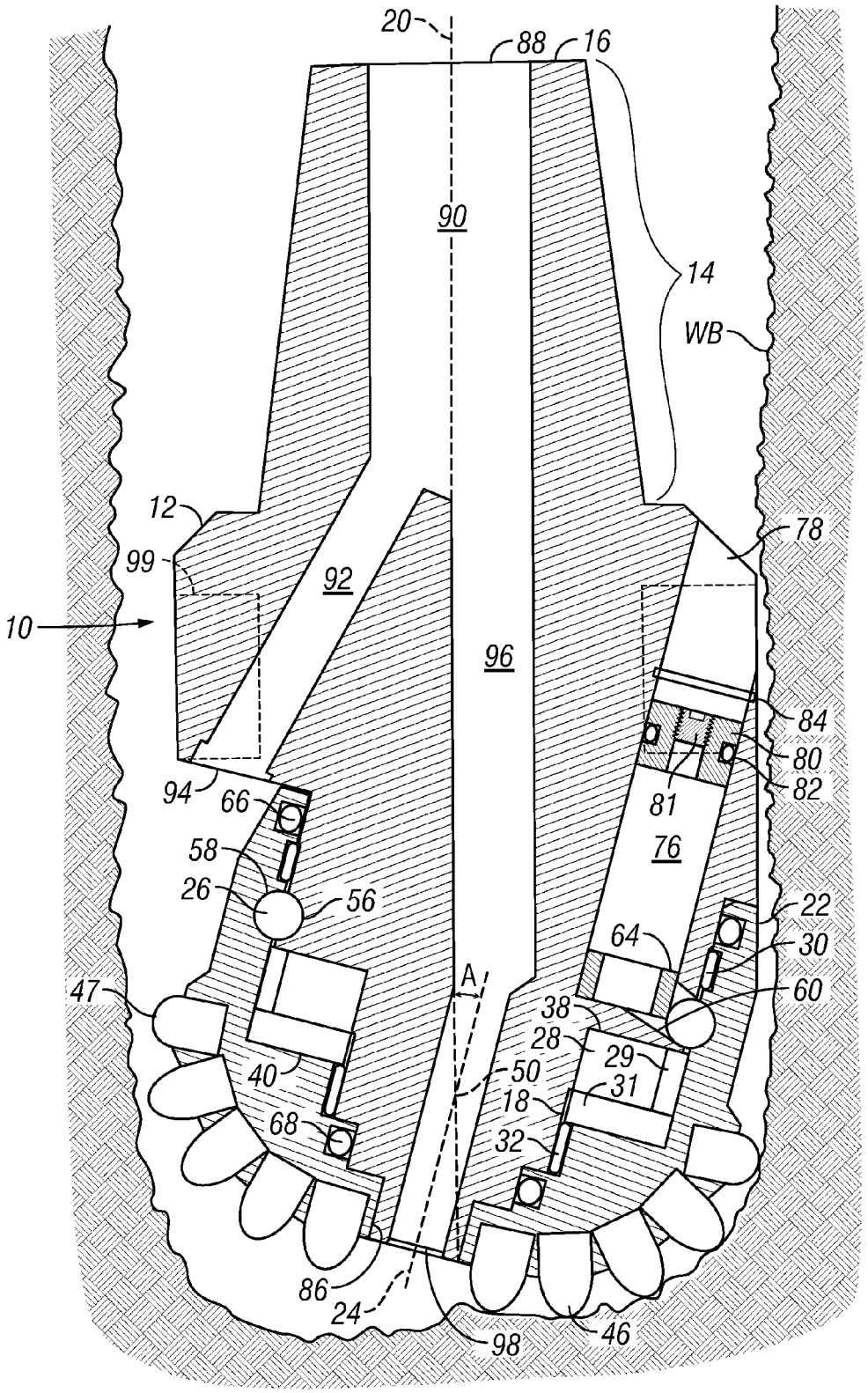
FIG. 1 is a cross-sectional schematic view of a lubricating nutating single cone drill bit, according to one embodiment of the invention.

FIG. 1 is a cross-sectional schematic view of a lubricating nutating single cone drill bit 10. The bit 10 includes a bit shank 12 with a threaded drill string connection 14 adjacent the proximal end 16 and an axially skewed journal 18 formed on a distal end of the bit shank 12. The journal 18 is axially skewed at an acute angle A relative to the central axis 20 of the bit shank 12. The bit shank 12 and axially skewed journal 18 can be formed as one piece, as shown. The axis of rotation 24 of the cutter body 22 can be skewed about 10° from the central axis 20 of the bit shank 12, however any acute skew angle can be utilized, preferably consistent with the disclosure made in U.S. Pat. No. 6,892,828, for example, from about 70 to about 14° . Cutter body 22 has an inside surface formed respectively to the axially skewed journal 18 to allow at least partial disposition in mating engagement thereupon. As the cutter body 22 rotates on the axially skewed journal 18, at least one bearing can be disposed therebetween to aid or enable rotation. The plurality of bearings in the illustrated embodiment includes ball bearings 26, a thrust bearing 28, and radial bearings (30, 32). The invention is not limited to the illustrated bearings or bearing location. Any type of bearings known to one of ordinary skill in the art of tribology can be used.

Figure 2:
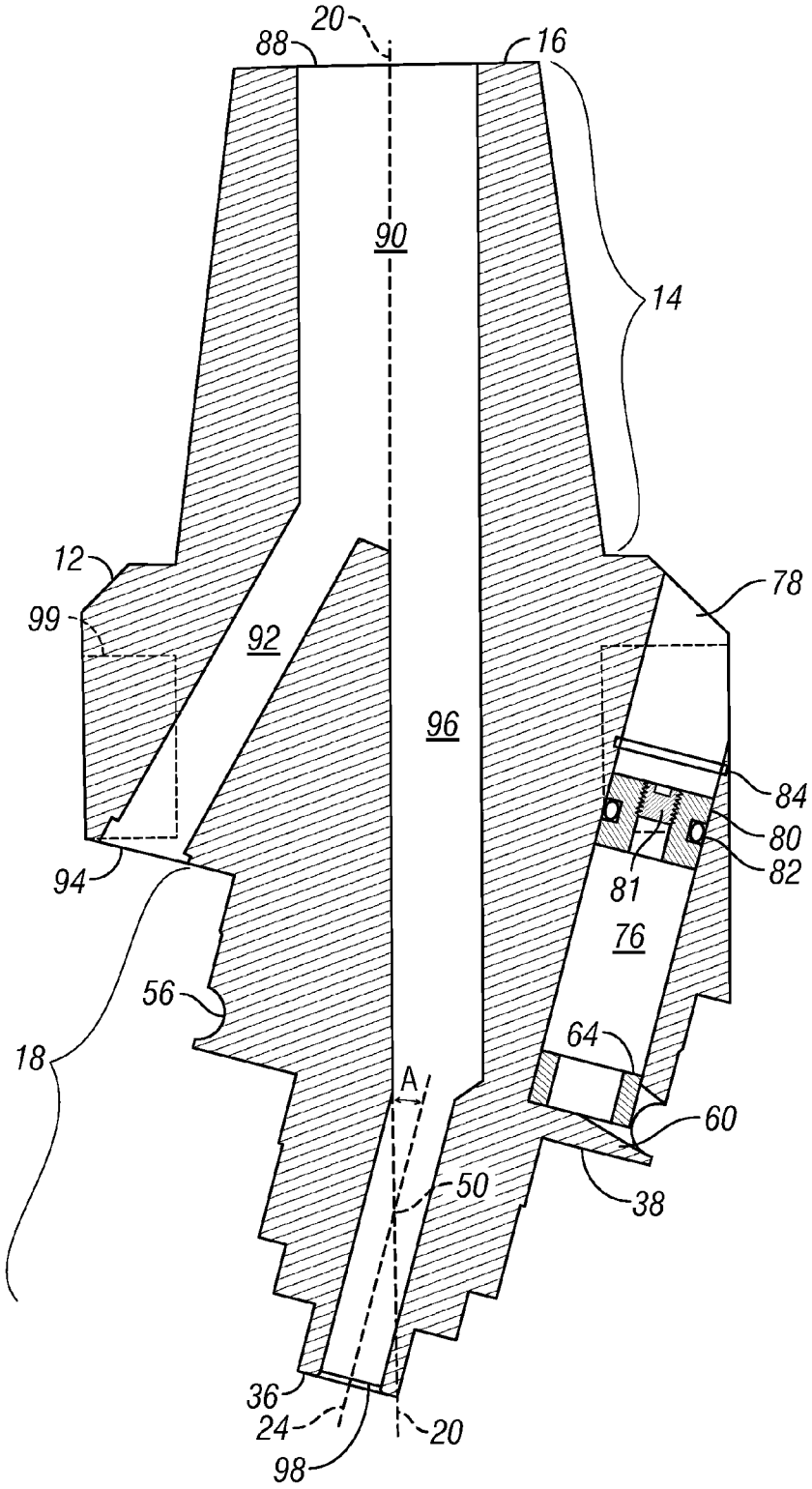
FIG. 2 is a cross-sectional schematic view of a bit shank with an axially skewed journal before installation of a cutter body or bearings, according to one embodiment of the invention.

As seen more readily in FIG. 2, bit shank 12 includes a narrow journal portion 18 extending between a distal end 36 and a thrust shoulder 38. A respective cutter body thrust shoulder 40, shown in FIG. 1, is formed in the interior of the cutter body 22. Thrust bearing 28 is disposed between the cutter body thrust shoulder 40 and the thrust shoulder 38 of the journal portion 18. In the illustrated embodiment, thrust bearing 28 is disposed concentrically within a bearing cage 29 and axially between a hardened seat 31 and the journal thrust shoulder 38. However, a hardened seat 31 can be included between either or both of the thrust shoulders (38, 40) and the thrust bearing 28. A first radial bearing 30 is disposed adjacent a proximal end of the interior of the cutter body 22 and a second radial bearing 32 disposed adjacent a distal end of the interior of the cutter body 22. Thrust bearing 28 can be selected to support a desired amount of load on the bit 10. Any of the bearings (28, 30, 32) can be a rubbing, or metal-to-metal, bearing or a rolling element bearing, as known to one of ordinary skill in the art. For example, thrust bearing 28 can be a rolling thrust bearing with ball, roller, or needle bearings.

Single cone cutter body 22 includes a plurality of cutter elements 46 on the distal end of the cutter body 22. As shown in FIG. 1, every cutter element 46 is affixed to the cutter body 22 so that a tip of each cutter element 46 is forward an intersection 50 of a central axis 20 of the bit shank 12 and an axis of rotation 24 of the cutter body 22. By having each cutter element 46 tip forward a plane defined normal to the axis of rotation 24 of the cutter body 22 at the intersection 50 of the axis of rotation 24 of the cutter body 22 and the central axis 20 of the bit shank 12, a preferred crushing, and not scraping, engagement of the well bore (WB) floor is achieved while avoiding a scraping of the well bore (WB) wall. Similarly, a first radial distance to the tip of each cutter element 46 from an axis of cutter body rotation 24 can be longer than a second radial distance to the tip of said cutter element 46 from the central axis 20 of the bit shank 12 when the cutter element 46 is in engagement with the well bore (WB) floor. Wear buttons 47 along outer peripheral lateral edge are optional and are not for cutting or crushing, but protection against incidental contact with well bore (WB), but in any case are preferably forward the plane including the intersection at point 50 and normal to the axis of rotation 24 of cutter body 22, as shown.

To assemble the lubricating nutating single cone drill bit 10, the thrust bearing 28 and the first 30 and second 32 radial bearings are disposed between the cutter body 22 and the bit shank 12. In the illustrated embodiment, a thrust bearing 28 is disposed concentrically within a cage 29 and adjacent a hardened seat 31 before assembly, such a subassembly (e.g., thrust bearing 28, cage 29, and hardened seat 31) can be referred to in its entirety as a thrust bearing. With the above components installed in the interior of the cutter body 22 and/or on the axially skewed journal 18, the cutter body 22 can be inserted onto the axially skewed journal 18 of the bit shank 12.

To allow rotation, the cutter body 22 and the axially skewed bore 18 are preferably sized relative to each other to provide a gap therebetween, said gap can include bearings. After the cutter body 22 is inserted onto the axially skewed journal 18, at least one ball bearing 26 can then be added therebetween to limit axial movement of the cutter body 22 relative to the axially skewed journal 18, and thus impede separation of the bit shank 12 and cutter body 22.

The bearing race to house the ball bearings 26 can include a first channel 56 circumferentially formed in the axially skewed journal 18 portion of the bit shank 12 and a second channel 58 circumferentially formed in the interior of the cutter body 22. To allow the insertion of ball bearings 26 into the bearing race (56, 58) of the bit 10, a ball bearing passage 60 is formed in the bit shank 12. Ball bearing passage 60 can be selected to allow ball bearings 26 to be disposed through the lubricant chamber 76 into the bearing race (56, 58). Ball bearings 26 can be retained within bearing race (56, 58) by a ball bearing retention sleeve 64. Ball bearing retention sleeve 64 can be retained in the distal end of lubricant chamber 76, for example, by threads (not shown), a friction fit, or a snap ring (not shown). Ball bearing retention sleeve 64 is sized to retain a ball bearing 26 from ejecting itself from the bearing race (56, 58) through ball bearing passage 60. As the outer surface of ball bearing retention sleeve 64 forms a section of the first channel 56 in the axially skewed journal 18, it is preferably retained in a position so as to not interfere with the rolling of the ball bearings 26. So configured, a plurality of ball bearings 26 can be added to the bearing race (56, 58) through the lubricant chamber 76 and ball bearing passage 60, and the ball bearing retention sleeve 64 installed to retain the ball bearings 26. The number of ball bearings 26 utilized is design dependent, but is preferably a full-complement.

Lubricant can be added to the bearings (26, 28, 30, 32) at any time before, during, or after assembly. For example, bearings and/or surfaces between the axially skewed journal 18 and the cutter body 22 interior can be coated with lubricant during assembly. To retain the lubricant and to restrict the ingress of any contaminants, the invention includes a set of seals (66, 68) between the cutter body 22 and the axially skewed journal 18. In a preferred embodiment, the seals (66, 68) are radial dynamic seals. A radial seal is typically designed for an interference fit on the diameters between two concentric, or somewhat eccentric, cylinders. As used herein, the term dynamic seal shall refer to a seal wherein at least one face of a seal substantially retains a sealing engagement when in contact with a dynamic or other motile surface, for example, a rotating shaft. A radial dynamic seal (66, 68) can be any appropriate seal, including, but not limited to, an O-ring, 30 square-ring, U-cup seal, shaft seal, etc.

Radial dynamic seals (66, 68) are typically installed in a groove in a housing (e.g., a groove in the interior bore of the cutter body 22) and compress against a shaft (e.g., the axially skewed journal 18). A first radial dynamic seal 66 is disposed adjacent a proximal end of the cutter body 22 and circumferential the proximal portion of the axially skewed journal 18. A second radial dynamic seal 68 is disposed adjacent the distal end of the cutter body 22 and circumferential the distal portion 36 of the axially skewed journal 18. The first 66 and second 68 radial dynamic seals are preferably axially spaced to define a gap therebetween containing a bearing (e.g., 26, 28, 30, and/or 32). Optionally, a portion of the axially skewed journal 18 and/or a portion of the interior or exterior of the cutter body 22 can be formed from, or coated with, a hardened material. In a preferred embodiment, the hardening adds corrosion resistance suitable for use in a downhole environment. Non limiting examples of hardening are nitriding, alloying, cyaniding, and quenching-polishing-quenching (QPQ).

Alternatively, a radial dynamic seal (66, 68) can be disposed in a groove (not shown) formed in the axially skewed journal 18, a groove in the cutter body 22 (as shown), or a combination thereof. In the embodiment of FIG. 1, a lubricant disposed in the gap between the cutter body 22 and the axially skewed journal 18 is bounded by the radial dynamic seals (66, 68). Such a configuration protects the bearings (26, 28, 30, 32) from contamination, for example, from drilling fluid or cuttings.

To provide lubrication, which is preferably continuous, the invention includes a lubricant chamber 76 formed in bit shank 12. The proximal end of the lubricant chamber 76 forms a fluid inlet port 78 on an exterior of the bit shank 12, illustrated as adjacent a drill string connection 14 shoulder. The distal end of the lubricant chamber 76 is in communication with the gap formed between the cutter body 22 and the axially skewed journal 18 of the bit shank 12. The gap is conventionally bounded by first 66 and second 68 radial dynamic seals and is sized to provide clearance to allow rotation of the cutter body 22.

The lubricant chamber 76 is in communication with the bearing surfaces. In the illustrated embodiment, the distal end of the lubricant chamber 76 is in communication with ball bearing passage 60, said ball bearing passage 60 in further communication with ball bearing race (56, 58).

Communication between ball bearing passage 60, which is optionally cylindrical, and lubricant chamber 76 can be achieved by an intersection therebetween for ease of manufacture. So configured, the lubricant chamber 76 is in communication with the gap formed between cutter body 22 and the axially skewed bore 18 bounded by first 66 and second 68 radial dynamic seals through the ball bearing passage 60.

After insertion of ball bearings 26 into bearing race (56, 58), a ball bearing retention sleeve 64 can be inserted into lubricant passage 76 to inhibit the egress of the ball bearing 26 from the port of the ball bearing passage 60 in first channel 56 of ball bearing race (56, 58). In one embodiment, the axis of the ball bearing passage 60 is not perpendicular to the axis of the lubricant chamber 76, as shown. Such a skew of the ball bearing passage 60 allows a lubricant to flow through the bore of the ball bearing retention sleeve 64, into the ball bearing passage 60, and thus to the bearings (26, 28, 30, 32). Similarly, the ball bearing retention sleeve 64 can have radially extending passages in a wall thereof to allow the passage of lubricant therethrough into the ball bearing passage 60. In the illustrated embodiment, the port of the ball bearing passage 60 in the first channel 56 of the ball bearing race (56, 58) functions as both a lubricant flow passage and bearing insertion aperture. Any space between the ball bearings 26 and the race (56, 58) allows a lubricant to flow past the ball bearings 26 and into the gap formed between the cutter body 22 and the axially skewed journal 18 as bounded by the first 66 and second 68 radial dynamic seals. Lubricant chamber 76 can be in communication with the gap between the axially skewed journal 18 and the cutter body 22 at any location and is not limited to being in communication with the ball bearing race (56, 58) as shown. An axially skewed journal 18 can provide a larger unitary volume of lubricant chamber 76 due to the offset nature of the journal 18 providing a larger continuous volume in the shank 12 as compared with a lubricant chamber that has a parallel axis to the shank (i.e., journal 18, if substantially coaxial to bit shank 12, would decrease the volume of bit shank 12 usable to form the lubricant chamber 76).

A lubricant can then be added to the lubricating nutating single cone drill bit 10, by any means known in the art. A lubricant can be any type in the art, including those conventionally known as grease. A lubricant can be a liquid without departing from the spirit of the invention. The lubricant chamber 76 can optionally be used during assembly to inject a lubricant into the gap between the cutter body 22 and axially skewed journal 18 (e.g., to the bearings 26, 28, 30, 32). In one embodiment, lubricant can be added to the bearings (26, 28, 30, 32) and/or the lubricant chamber 76 by any means known in the art. A plunger 80 can be disposed within the lubricant chamber 76, for example, to prevent the ingress of annulus fluid and/or the egress of lubricant. Plunger 80 can include a longitudinal bore therethrough. A plug 81 can be inserted into the longitudinal bore of the plunger 80 to form a seal, as shown. In one embodiment, the plug 81 threadably engages the longitudinal bore of the plunger 80. A removable plug can allow the disposition of lubricant through the plug 81 when desired. Plug 81 can include any type of drive, for example, a hexagonal socket drive as shown. Plunger 80 can include a built-in sealing mechanism (not shown), or have a radial seal 82 and respective seal grove formed in the plunger 80 or vice-versa. Plunger 80 can be a compensating piston, as is known in the art, to aid in the dispensing of the lubricant. To retain a plunger 80 within a lubricant chamber 76, a snap ring 84 (or equivalent) can be disposed in a groove in the proximal end of the lubricant chamber 76. The inner diameter of the snap ring 84 is preferably sized to restrict the passage of the plunger 80.

Lubricating nutating single cone drill bit 10 also includes a fluid passage 90 formed therethrough to allow the passage of a drilling fluid, for example. Fluid passage 90 extends from a second fluid inlet port 88. Second fluid inlet port 88 is in the proximal end 16 of the bit shank 12 and is preferably in communication with a bore of a drill string attached to the drill string connection 14. Fluid passage 90 includes a first section 96 of fluid passage 90 through the bit shank 12. First section 96 of fluid passage 90 is in communication with a fluid outlet port 98 located on the distal end 36 of bit shank 12, or more specifically, of the axially skewed journal 18. Second section 92 of fluid passage 90 is in communication with a second fluid outlet port 94 on the exterior of the bit shank 12. In the illustrated embodiment, second fluid outlet port 94 is formed in a shoulder defined by a recess in the shank 12. Although not shown in the view of FIGS. 1-2, a plurality of the second fluid outlet ports 94, for example, dual fluid outlet ports 94 in said shoulder, can be used without departing from the spirit of the invention. The plane of the shoulder, and thus the second fluid outlet port 94 therein, can be normal to the axis of rotation 24 of the cutter body 22. Such an arrangement allows drilling fluid to be discharged substantially parallel to the axis of rotation 24 of the cutter body 22 and into the well bore (WB), or more specifically, the well bore wall if desired. Any fluid outlet port (94, 98) can include a high pressure jet or a low pressure orifice, as is known to one of ordinary skill in the art. Although the first 96 and second 92 sections of fluid passage 90, and respective fluid outlet ports (98, 94), are shown as branching off a single portion of fluid passage 90, the first 96 and second 92 sections of fluid passage 90 can extend to proximal end 16 of bit shank 12 without intercommunication therebetween and remain within the spirit of the invention. Cutter body 22 is shown with an opening 86 in a distal end thereof to allow the protrusion of the distal end 36 of the axially skewed journal 18 therethrough, however the distal end 36 of the axially skewed journal 18 is not required to extend therethrough and any configuration of fluid outlet can be utilized.

To use, the lubricating nutating single cone drill bit 10 is attached to a drill string (not shown) by a drill string connection 14, for example, including box threads. Bit shank 12 can include an optional bit breaker slot 99, shown as a dotted line, formed in the outer surface to permit the engagement and disengagement of bit 10 and drill string. Nutating single cone drill bit 10 can then be engaged into a formation to form a well bore (WB), as is known the art. The orientation of the cutter or crushing elements 46 and the axially offset geometry of the cutter body 22 with respect to the axis 20 of the bit shank 12 enables a portion of cutter or crushing elements 46 to contact the well bore (WB) while the adjacent section of cutter or crushing elements does not contact the floor of the well bore (WB). Such a configuration can minimize or eliminate the dragging of the cutter or crushing elements 46 across the opposing face of the well bore (WB) and thereby reduce the wear experienced by the bit 10 overall. The rolling nutating action of the present bit 10 offers low resistance to the rotational movement of the drill string, and thus provides a much lower operating torque that allows for operation at a higher rotational speed as compared to a typical scraping drill bit.

The lubricating nutating single cone drill bit 10 can then be rotated and loaded to drill the formation as is known to one of ordinary skill in the art. The drilling fluid is pumped down the drill string and into contact with the proximal end 16 of the bit shank 12. Any fluid pumped through an attached drill string will thus flow into the fluid inlet port 88, through fluid passage 90 and into first 96 and second 92 fluid passage sections. Fluid can then flow through first fluid passage section 96 and discharge from the fluid outlet port 98 formed in the distal end 36 of the axially skewed journal 18 into the face of the well bore (WB). Fluid can concurrently flow through second fluid passage section 92 and discharge from the fluid outlet port 92 in a shoulder in the lateral wall of the bit shank 12 into well bore wall. The first 66 and second 68 radial dynamic seals form a fluid barrier between the axially skewed journal 18 and the interior of the cutter body 22.

A well bore (WB) typically contains a fluid referred to as an annulus fluid which can include, for example, drilling fluid discharged from the bit 10 and/or a formation fluid. The annulus fluid can act on the proximal end of plunger 80. The proximal face of first radial dynamic seal 66 can be acted on by the annulus fluid (e.g., at the annulus fluid pressure) and the distal face of the first radial dynamic seal 66 can be acted on by a lubricant pressurized by plunger 80 at the annulus fluid pressure. Similarly, the distal face of second radial dynamic seal 68 can be acted on by the annulus fluid (e.g., at the annulus fluid pressure) and the proximal face of the second radial dynamic seal 68 can be acted on by a lubricant pressurized by plunger 80 at the annulus fluid pressure. In such an embodiment, the faces of each radial dynamic seal (66, 68) are contacted by fluid(s) at substantially equivalent pressures, more specifically an annulus fluid and a lubricant both at the annulus fluid pressure, and no pressure differential is experienced. Such a balanced configuration aids in the prevention of the undesirable ingress of drilling fluid into the rotational bearing surfaces due to unbalanced pressures on a radial seal. The lubricant chamber 76 allows for longer periods of use of a lubricating nutating single cone drill bit 10 without repacking lubricant and/or replacing any bearings (26, 28, 30, 32). The consumption of lubricant can allow additional lubricant to replenish the bearings (26, 28, 30, 32) and a corresponding displacement of the plunger 80 can occur.

While the invention has been described with respect to a limited number of embodiments, those skilled in the art will appreciate numerous modifications and variations therefrom. It is intended that the appended claims cover all such modifications and variations as fall within the true spirit and scope of the invention.

What is claimed is:

1. A lubricating nutating single cone drill bit comprising:

a bit shank having a drill string connection on a proximal end and an axially skewed journal on a distal end;

at least one bearing rotatably retaining a cutter body on the axially skewed journal;

a plurality of cutter elements affixed to a distal end of the cutter body so that a tip of each cutter element is forward an intersection of a central axis of the bit shank and an axis of rotation of the cutter body and a first radial distance to the tip of each cutter element from the axis of rotation of the cutter body is longer than a second radial distance to said tip of each cutter element from the central axis of the bit shank, upon contact with a borehole floor;

a lubricant chamber in the bit shank in communication with a first fluid inlet port on an exterior of the bit shank and at least one bearing;

a plunger in the lubricant chamber inhibiting the ingress of an annulus fluid;

a first fluid outlet port on a distal end of the journal extending through an opening in the cutter body and in communication with a fluid passage the bit shank in, the fluid passage thereby in communication with a second fluid inlet port in the proximal end of the bit shank; and, a second fluid outlet port on the exterior of the bit shank in communication with the fluid passage.

2. The lubricating nutating single cone drill bit of claim 1 wherein the at least one bearing comprises at least one ball bearing disposed between a first channel formed in the axially skewed journal comprising a narrow portion at a distal end and a thrust shoulder adjacent the narrow portion and a second channel formed in an interior of the cutter body having a thrust bearing disposed between the thrust shoulder of the axially skewed journal and a thrust shoulder in the interior of the cutter body.

3. The lubricating nutating single cone drill bit of claim 2 wherein the at least one bearing further comprises at least one radial bearing disposed between the axially skewed journal and the cutter body.

4. The lubricating nutating single cone drill bit of claim 2 further comprising a ball bearing passage connecting the first channel and the lubricant chamber to allow the insertion of the at least one ball bearing therethrough and a ball bearing retention sleeve disposed in the lubricant chamber adjacent the ball bearing passage to retain the at least one ball bearing between the first and the second channel.

5. The lubricating nutating single cone drill bit of claim 1 wherein at least one of the fluid outlet ports comprises a jetting nozzle.

6. The lubricating nutating single cone drill bit of claim 1 wherein the plunger further comprises:

a longitudinal bore extending therethrough; and a plug sealed within the longitudinal bore.

7. A method to drill a formation comprising:

attaching the lubricating nutating single cone drill bit of claim 1 to a drill string to form an assembly;

engaging the assembly into the formation;

rotating the drill string to drill the formation with the lubricating nutating single cone drill bit to produce a well bore, the lubricant chamber dispensing a lubricant to the at least one bearing; and pumping the drilling fluid through the drill string into the second fluid inlet port and out of the first and the second fluid outlet ports.

8. The method to drill a formation of claim 7 further comprising:

removing the lubricating nutating single cone drill bit from the well bore; and replenishing the lubricant in the lubricant chamber.

* * * * *